US005749420A

United States Patent [19]

Jansson

[11] Patent Number: 5,749,420

[45] Date of Patent: May 12, 1998

[54] DEVICE FOR PARTICLES DETECTION IN A PIPELINE

[75] Inventor: Lennart Carl Erik Jansson, Värmdö, Sweden

[73] Assignee: Firefly AB, Huddinge, Sweden

[21] Appl. No.: 624,486

[22] PCT Filed: Oct. 3, 1994

[86] PCT No.: PCT/SE94/00908

§ 371 Date: Apr. 4, 1996

§ 102(e) Date: Apr. 4, 1996

[87] PCT Pub. No.: WO95/10330

PCT Pub. Date: Apr. 20, 1995

[30] Foreign Application Priority Data

Oct. 8, 1993 [SE] Sweden ..... 9303306

[51] Int. Cl.[6] ..... A62C 3/00

[52] U.S. Cl. ..... 169/54; 169/60; 169/61; 340/584

[58] Field of Search ..... 169/54, 60, 61; 340/578, 584; 250/339.15, 554

[56] References Cited

U.S. PATENT DOCUMENTS

| | | | |
|---|---|---|---|
| 3,824,392 | 7/1974 | Tibbling | 340/578 X |
| 3,909,954 | 10/1975 | Zoukourian | 16/61 X |
| 5,193,622 | 3/1993 | Tibbling | 169/54 |

FOREIGN PATENT DOCUMENTS 1729528 4/1992 U.S.S.R. .

OTHER PUBLICATIONS

"Unit for Smouldering Particles Detection in Pneumo Transport Ducts–Using Light Conductors Whose Receiving Ends Are Situated in Fan, and Are In Plane Perpendicular to Material Flow Direction", Derwent's Abstract, No. 93–115518/14, week 9314, Abstract of SU 1729528 (Optical Inst Vavilov), 30 Apr. 1992.

*Primary Examiner*—Andrew C. Pike

*Attorney, Agent, or Firm*—Burns, Doane, Swecker & Mathis, L.L.P.

[57] ABSTRACT

A detector arrangement is included in a preventive safety system that can be used within a process in which loosely formed process material is produced in a first unit (1) and transported (3) to a receiving, second unit (2), wherein the treatment to which the material is subjected in said first unit is liable to produce one or more discrete particles which have a temperature sufficiently high to initiate fire and/or explosion within at least the second part or unit (2). The necessary transportation of the loose material between the first unit (1) and the second unit (2) is effected along a path which includes a stabilizing zone (7), a high temperature particle indicating zone (8), and an extinguishing zone (9), wherein the indicating zone includes one or more particle sensors (10). The sensors coact with an indicating and activating unit (12) such that indication by the sensors of the presence of a high-temperature particle in said indicating and activating unit will activate a device which is associated with the extinguishing zone and which functions to deliver an extinguishing agent and/or to remove particles (15). The sensing lobes of two sensor units (105, 107) cover a cross section of the transportation path. The indicating and activating unit (12) is adapted to evaluate the sensed intensity from each of said sensor units (105, 107) and to coordinate received intensity-dependent signals so as to calculate and establish on the basis thereof the liability of the particle to initiate fire and/or explosion.

16 Claims, 2 Drawing Sheets

DEVICE FOR PARTICLES DETECTION IN A PIPELINE

TECHNICAL FIELD

The present invention relates to a detector or sensor arrangement, which functions to detect those particles in a stream of loose particles or loosely formed material that have such a high temperature and/or such a high energy content as to constitute an incitement to fire or explosion in a downstream particle-collecting risk zone.

By loose material is meant all types of material that can be transported with the aid of a gas or gas mixture, normally air, in which the particles of material are spaced from one another.

Material of the kind meant here may consist in extremely fine, dust-like particles. The material may also consist in powder or granular particles, and will also include wood chips, pellets, straw, and like transportable materials.

The inventive detector arrangement is intended for use in a preventive safety system that can be used in a process in which loose process material is produced in a first unit and transported therefrom to a receiving, second unit, and in which the treatment to which the material is subjected in the first unit can result in individual particles or several particles being heated to a temperature which is sufficiently high to initiate a fire and/or an explosion within at least the second part or unit of the system, wherein as the loose material is transported from the first unit to the second unit it will pass through a stabilizing zone or disturbance zone, a high-temperature particle indicating zone, an effectuating zone, and a risk zone located in the proximity of or in the second unit.

The stabilizing zone is intended for particles of low energy content which do not constitute a fire risk or explosion risk within the downstream zones, and particularly in the risk zone. The stabilizing zone is effective in reducing the energy content of such particles so that they will not be indicated in the indicating zone located immediately downstream of the stabilizing zone.

The indicating zone includes one or more sensors or detectors which are intended to indicate the presence of hazardous particles whose energy content is likely to cause a fire in the downstream zones, and then particularly in the risk zone. The sensors coact with an indicating and activating unit, such that sensing of the presence of hazardous particles will result in the activation of a device or an arrangement which delivers an extinguishing agent and/or which functions to remove particles from the system and which is included in the extinguishing zone.

The indicating zone is followed by an effectuating zone whose length is adapted so that the device activated within the extinguishing zone will have time to effectuate an extinguishing barrier before or when the hazardous particle reaches said zone.

The extinguishing zone may have the form of a valve which functions to deflect a particle collection containing said hazardous particles from the transportation path leading to the risk zone.

DESCRIPTION OF THE PRIOR ART

A preventive safety system of the aforedefined kind is known to the art and is marketed by Firefly AB, Huddinge, Sweden, this preventive safety system being intended to indicate the presence of sparks and glowing particles and to apply extinguishing or smothering means so that glowing particles will not reach the downstream process unit, such as a filter, a silo, or like device, or the risk zone, in which fire and/or an explosion might otherwise occur.

The preventive safety system utilizes different detector systems for sensing the aforesaid particles.

These detector systems for sensing the aforesaid particles which are used in industrial processes react too slowly to limit the extent to which damage is caused.

It is known to utilize temperature sensors, although practical experiences have shown that such sensors often remain inactive until a fire has actually started.

It is true that flame detectors are sensitive to small flames, but such detectors react much too late and cannot therefore be used in a preventive safety system.

It is also known to use pressure detectors or sensors which are highly sensitive and operate with small time constants. These sensors, however, normally require an initial explosion or a fire before they are able to react.

It is also known to uses a sensor arrangement which is able to indicate the presence of particles having a temperature down to 400° C.

Practical experiences indicate that particles transported in a transportation path and having a temperature range slightly above 400° C. will represent a risk of fire and explosion in different process plants in which combustible, finely divided material is transported with the aid of a gas or gas mixture, such as an air stream, for instance.

SUMMARY OF THE INVENTION

TECHNICAL PROBLEMS

The primary object of the present invention is to further improve known detector arrangements which are constructed to indicate the presence of particles that have a temperature somewhat above 400° C. and therewith enable such an arrangement to be included in a preventive safety system of the aforesaid kind. It will be seen in this regard that a technical problem exists in realizing the advantages that are afforded when at least two detector units have sensing lobes cover a cross section of the transportation path and to evaluate the energy content of an indicated particle a high degree of accuracy in response to received signals, irrespective of the orientation within said cross section and while taking into account, i.e., observing, the distance from respective sensors or detectors.

It will also be seen that a technical problem is one of realizing the significance of adapting an indicating and activating unit to evaluate the intensity sensed by each of these detector units, and to coordinate the received intensity-dependent signals so as to enable the likelihood of the particles to initiate a fire and/or explosion in a downstream risk zone to be calculated and established.

It will also be seen that a technical problem resides in the significance of arranging the detector units or sensors diametrically on the inner peripheral surface of a material transporting tube of circular cross section, or to arrange said units uniformly around said inner tube periphery, and also to realize the significance of the number and orientation of the detector units used.

It will also be seen that another technical problem is one of realizing the significance of placing the detector units opposite to one another around the inner peripheral surface of a tube that has an angular cross section, and to realize the significance of placing the detector units in the corners of said cross section.

Another technical problem is one of realizing the significance of arranging the detector units symmetrically and in mutually opposed relationship around the inner peripheral surface of a tube of square or rectangular cross section, and to realize for which applications the detector units shall be corner-related.

A technical problem is also one of realizing that the intensity-dependent signals shall be fully or partially summatable and/or mean-value forming with a correction factor, and capable of being evaluated in a comparison circuit in order to establish whether or not the received signals exceed a specific value, and in another circuit evaluate the value on the basis of which an activation signal is sent to appropriate extinguishing equipment.

It will be understood that a detector unit may be given a sensing or detecting angle of about 180° and have a semicircular sensing lobe.

Another technical problem resides in realizing the significance of covering each detector or sensor with a protective cover which includes a number of mutually adjacent slots which extend perpendicularly or essentially perpendicularly to the feed direction of the material, wherein all detector units are coordinated around one and the same transverse plane through the transportation path.

SOLUTION

With the intention of solving one or more of the aforesaid technical problems, there is proposed in accordance with the present invention a detector arrangement which may be included advantageously in a preventive safety system defined in the introduction, having light-sensitive means in the form of phototransistors and associated sensing circuits for detecting high-energy particles, such as particles having a temperature above 400° C.

In accordance with the invention, the inventive detector arrangement includes at least two detector units which generate individual sensing lobes that cover a cross section of the transportation path, and the indicating and activating unit is adapted to evaluate the intensity sensed by each of said detector units and to coordinate the intensity-dependent signals received so as to calculate and establish the particle energy content or a corresponding value, and therewith establish the capacity of the particle to cause a fire and/or explosion in a specific system.

According to proposed embodiments which fall within the scope of the inventive concept, the detector units are disposed diametrically on or uniformly around an inner peripheral surface of a tube of circular cross section.

According to another embodiment, the detector units are mounted opposite one another around the inner peripheral surface of a tube of angular cross section, wherein the detector units are located in relation to the corners of said cross section.

According to another embodiment, the detector units are mounted symmetrically and in opposite relationship around an inner peripheral surface of a tube of square or rectangular cross section, wherein the detector units will preferably be corner-related in respect of certain applications.

According to another embodiment, the intensity-dependent signals are fully or partially summatable and/or mean-value forming with a correction factor, and can be evaluated in a comparison circuit for the purpose of ascertaining whether or not a received signal or signals exceeds/exceed a given value, wherein a further value can be evaluated in another circuit on the basis of the former value in order to choose the extent to which extinguishing equipment shall be activated.

According to one particular embodiment of the invention, each detector or sensor has a sensing angle of about 180°.

According to another embodiment of the invention, each sensor or detector is preferably covered with a protective screen which includes a plurality of mutually adjacent slots which extend at right angles or essentially at right angles to the direction of movement of the material, wherein all detectors are orientated in one and the same plane or at least orientated so that a particle which passes two or more detectors can be evaluated simultaneously by all detectors.

ADVANTAGES

Those advantages which can be considered particularly characteristic of an inventive detector arrangement, and particularly when the arrangement is included in a preventive safety system, reside in the provision of conditions which enable two or more detector units to ascertain the energy content of passing particles more accurately than was earlier possible, irrespective of the position of the particles within the cross section, by virtue of sensing or detecting one such particle simultaneously in each of the detector units, wherein the energy content of the particle is calculated on the basis of the particle intensity signal delivered to each of the detector units.

BRIEF DESCRIPTION OF THE DRAWINGS

An exemplifying embodiment of an inventive detector arrangement at present preferred will now be described in more detail with reference to the accompanying drawing, and also with reference to application of the detector arrangement in a preventive safety system, in which.

DESCRIPTION OF EMBODIMENTS PRESENTLY PREFERRED

Figure 1:
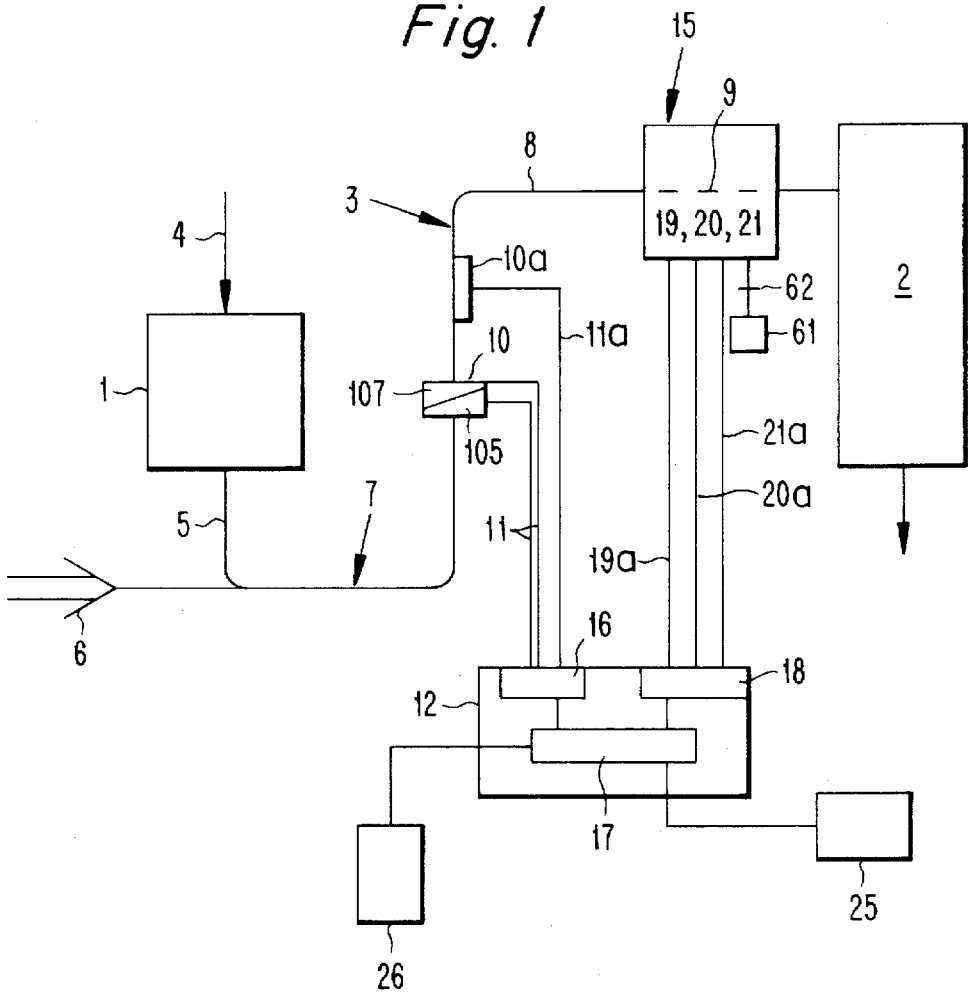
FIG. 1 is a block schematic which illustrates generally a processing plant in which an inventive detector arrangement is used, said arrangement being followed by an indicating and activating unit.

FIG. 1 illustrates a preventive safety system which can be used within a process, an industrial process, in which loosely formed process material is produced within a first unit 1 and can be transported to a receiving, second unit 2, by means of a conveyor 3.

The invention is based on the assumption that material treated in the unit 1 will produce individual particles or several particles which are heated to a temperature at which the particle or particles is/are liable to initiate fire and/or explosion in the system. One example in this regard is the disintegration of paper pulp which enters a mill 1 in the direction of the arrow 4 and from which the ultimate cellulose fluff is transported to the second unit 2, in the form of a silo, on a conveyor path 3 which includes a conduit system 7, 8, 9 with the aid of an airstream 6. Disintegration of the paper pulp in the unit 1 may result in individual particles or several discrete particles being heated to a temperature which is sufficiently high to cause a fire and/or explosion at least within the second part or second unit 2, and also within the particle transportation system 3.

Although the exemplifying embodiment is described with reference to the disintegration of paper pulp which is transported to a silo with the aid of an air stream, it will be obvious that the inventive concept can also be applied in other fields and for other purposes.

Another requirement is that the particles resulting from said disintegration are transported as loose material by a gas or gas mixture, normally air.

Another requirement is that the nature of the treatment carried out in the unit 1 is such as to be liable to produce particles whose heat content can constitute a risk of fire in the conduit system or in a storage space, i.e., in the so-called risk zone.

According to the present invention, the system 3 by means of which the loosely formed material exiting in the conduit 5 is transported between the first unit and the second unit 2 includes, among other things, a stabilizing zone 7, an indicating zone 8 which functions to indicate hazardous high-temperature particles, and an extinguishing zone 9 which precedes the second unit or risk zone 2.

The indicating zone 8 includes initially a plurality of known sensors 10, for instance of the kind described and illustrated in U.S. Pat. No. 3,824,392 to Tibbling, or other types of sensors that are able to detect the presence of such particles.

Several sensors 105 and 107 are able to coact with an indicating and activating unit 12 via the lines 11.

A high-temperature particle indicated by a sensor 10 will result in the unit 12 activating a device 15 which is associated with the extinguishing zone 9 and which delivers an extinguishing agent and/or removes the hazardous high-temperature particles.

In accordance with the invention, the detection-dependent intensity sensed in one or more sensors 10 can be evaluated in a circuit 16 included in the indicating and activating unit 12, and one of several available, indicated, and suitable measures or procedures can be activated in a calculating circuit 17 through the medium of a circuit 18.

The measure or procedure activated in this way may include one of a number of available devices, such as one of three devices 19, 20 and 21, depending on the nature of the activation signal on the lines 19*a*, 20*a*, or 21*a*.

Alternatively, one and the same device can be used to a greater or a lesser extent, by modifying the signal on one of the lines.

The invention also provides the possibility of programming the calculating circuit 17 so that the measure or procedure to be taken will be chosen by the circuit in accordance with the nature of the process, which can be loaded through a circuit 25 coupled to the unit 12.

In this regard, the measure or procedure chosen may constitute activation of a valve which is mounted in the conduit section 9 and which functions to deflect a particle collection which includes said hazardous particles into a discharge conduit 61.

The discharge conduit 61 includes a further valve flap 62, which may also be moved to an open position. Also available is a fire extinguishing system 63.

The sensor 10 is placed at a distance from the first unit 1 such that generated particles of low energy contents will pass respective sensors without initiating activation of the unit 12 and therewith without initiating a safety measure or procedure via the unit 18.

The aforementioned safety measures or safety procedures may also include the activation of the whole of a water-based extinguishing system or of solely parts of said system. For example different nozzles of an extinguishing system can be activated with the aid of signals arriving on the lines 19*a* and 20*a*.

The signal on the line 20*a* will activate two solenoid valves, in response to which the material under transportation will be sprayed with water held under pressure in a water delivery system.

The signal on the line 19*a* will activate one single additional solenoid valve.

The water delivery system is shut down in response to a signal on the line 21*a*.

In this case, the calculating unit 17 will select a safety measure or procedure and also the duration over which the safety measure or procedure shall remain in effect, in a simple programmable manner.

The unit 12 may also be programmed via a circuit 26 for the purpose of taking into-account process internal conditions, such as the nature of the chosen material, a necessary time delay depending on the instant speed at which material is transported, and where the instant speed can be evaluated by a sensor 10*a*, and a signal corresponding to this speed is sent to the circuit 17 on a line 11*a*.

The unit 12 may also be programmed to take into account the construction and method of operation of the extinguishing equipment, so that the extinguishing zone will become active immediately before a hazardous particle or hazardous particles enters or enter said zone.

Figure 2:
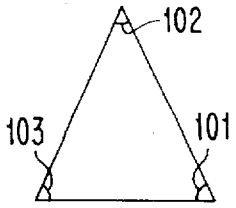
FIG. 2 is a cross-sectional view of a three-walled tube part in which a detector unit is positioned in each of the three corners of said tube.

FIG. 2 is a cross-sectional view of a tube which has a symmetrical triangular cross section and which is intended to transport airborne particles. Detector units 101, 102, and 103 are positioned in the three corners of the triangle.

Figure 3:
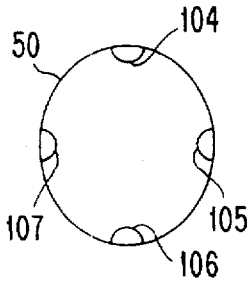
FIG. 3 illustrates a transport conduit of circular cross section in which four detector units are positioned symmetrically.

FIG. 3 illustrates a tube of circular cross section in which detector units 104, 105, 106, and 107 are positioned symmetrically with one another in direct opposite relationship. It will be understood that three detector units or more than four detector units may be used.

Figure 4:
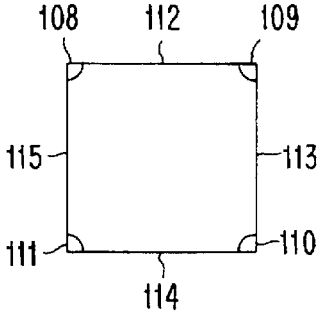
FIG. 4 illustrates a tube of square cross section with a detector unit positioned in each of the four corners.

FIG. 4 is a cross-sectional view of a four-cornered tube in which detector units 108, 109, 110, and 111 are placed in respective corners.

In the case of the FIG. 4 embodiment, it is possible to place the detector elements centrally with a sensing lobe of 180° for the side parts 112, 113, 114, and 115. The positioning of the detector elements will depend on the application concerned.

Figure 5:
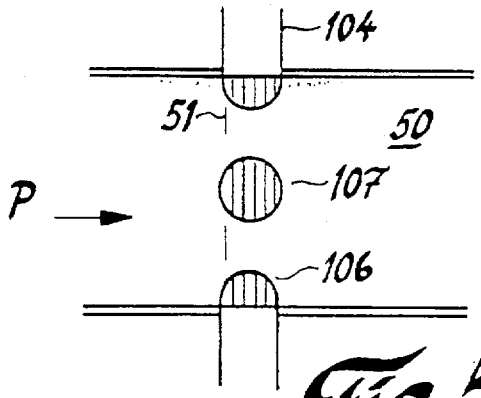
FIG. 5 is a cross-sectional view of the tube shown in FIG. 3, and illustrates the orientation of the detector units.

FIG. 5 is a cross-sectional view of an arrangement according to FIG. 3, in which the circular tube 50 has been cut through so that only the detector units 104, 106, and 107 can be seen.

An important feature of the present invention is that each of the detector units is provided with a number of slots, for instance seven, where each individual slot extends in a plane perpendicular to the transport direction.

For instance, respective first slots 1 positioned upstream of t;-Le transport direction P extend in a first plane 51, while respective second slots 2 extend in a second plane 52 which is parallel with the first plane, and so on, up to a plane 57.

Figure 6:
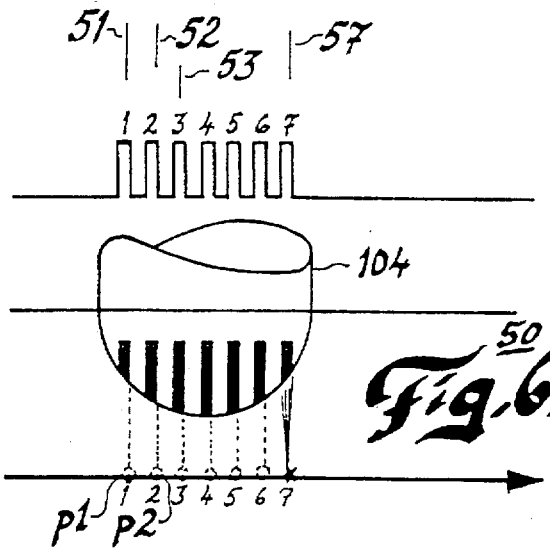
FIG. 6 illustrates an inventive principle of evaluating a high-temperature particle which passes each of the detector units.

FIG. 6 is intended to illustrate that a particle of elevated temperature will first pass (P1) the plane 51 and therewith initiate in the detector unit 104 a pulse which is associated with said plane 51. A signal of corresponding value is obtained in the detector unit 104 as the same particle passes the point P2.

Thus, a particle having a sufficient energy content will initiate a total of seven pulses as it passes through the all of the planes between planes 51 and 57 in the conduit 50.

A specific calculation is required to calculate and evaluate the result obtained from the indications given by the different detector units. Thus, in order to compensate as best as possible for the fact that the light intensity of a particle will decrease with the square of the distance from a detector and increase with the square of the distance towards a detector, an adapted calculation is preferably made of each of the signals received from the detectors, so as to be able to assess the instantaneous energy content of said particle.

Figure 7:
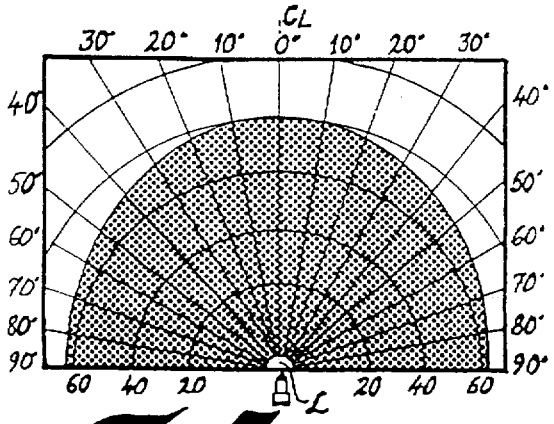
FIG. 7 is a sensitivity diagram relating to a used detector unit, with overlapping phototransistors.

FIG. 7 is a sensitivity diagram showing the sensitivity range of a detector unit with overlapping phototransistors. As illustrated in FIG. 7, during use of the detector unit, the sensitivity of such ranges from zero to 90° on both sides of the line $C_L$, i.e., 180°.

Figure 8:
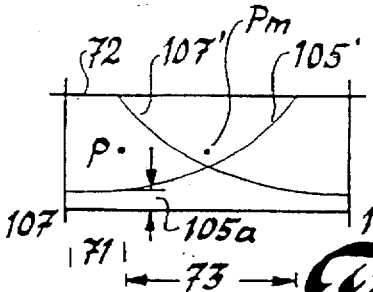
FIG. 8 illustrates the variation in the intensity of a particle at different distances from the detector, and those considerations that are necessary in evaluating the energy content of the particle at different positions in said cross section.

FIG. 8 illustrates a plane which extends between two detectors, such as the detectors 105 and 107 in FIG. 3.

The curve 107' is intended to illustrate the intensity of the light from a particle in dependence on its distance from the sensor 107, and the curve 105' is intended to illustrate the intensity of the light from the same particle in dependence on the distance from the sensor 105.

It is assumed that the particle (P) does not contain sufficient energy to trigger and activate the extinguishing equipment, but that it would cause the extinguishing equipment to be activated should the particle come very close to the sensor 107.

The particle generates in the region 71 a signal which is restricted by the level 72 in the sensor 107, but the value 105a is obtained in the sensor 105.

In this case, the calculating circuit inhibits the signal from the sensor 107 (the sensor 107 is saturated) and bases its calculations on signals from the sensor 105 and is able to evaluate the energy content of the particle in accordance with the distance between the two sensors 105 and 107.

If it is assumed that the particle is located in the middle (Pm), the signals from the two sensors will be equal to one another and can be added together. The addition or the mean value formed will result in a value which lies beneath the limit 72.

This evaluation is made within the region 73.

The level 72 can be raised and lowered and the curves 105' and 107' can be varied in accordance with preset limit values.

Although not shown, further levels shall be introduced, so as to be able to select activity modes.

The signal contributions from the sensors 104 and 106 can be considered to be constant within the region 73 and shall either be added together or a mean value formed with the values of remaining signals.

Thus, as soon as one of the sensors indicates "saturated", the signal information delivered by remaining sensors shall be processed. If two or more saturation states are indicated, it shall be assumed that the maximum level has been reached.

Calculating circuits which take these circumstances into account can be constructed without requiring work of an inventive nature.

It is also feasible within the scope of the invention that when a particle has passed through a selected number of planes, such as the planes 51, 52, and 53, and each of these planes has indicated a sufficiently high light signal to activate a device 15 which belongs to the extinguishing zone and which functions to deliver an extinguishing agent and/or functions to remove particles, the device will be activated after a specific number of clear indications have been given, for instance three indications.

The aforedescribed detector arrangement may be used advantageously in a preventive safety system of the kind defined in U.S. Pat. Ser. No. 08/624,473 entitled "Preventive Safety System" filed on Apr. 3, 1996.

It will be understood that the invention is not restricted to the aforedescribed and illustrated exemplifying embodiments thereof and that modifications can be made within the scope of the inventive concept as illustrated in the following claims.

I claim:

1. A safety system for use with a process in which loosely formed process material is produced in a first unit and transported to a receiving second unit along a path between the first and the second units, the material produced by said first unit being liable to produce discrete particles which have a temperature sufficiently high to initiate fire within at least the second unit, the path including a stabilizing zone, a high-temperature particle indicating zone, and an extinguishing zone having extinguishing means for extinguishing the discrete particles, the safety system comprising:

a sensor arrangement having at least two particle sensors located in the indicating zone, and an indicating and activating unit, the particle sensors including means for coacting with the indicating and activating unit by each sending an intensity signal for each of the discrete particles, the sensor arrangement having means for sensing over a cross section of the path an intensity of each of the discrete particles, the indicating and activating unit having means for evaluating a particle temperature intensity for one of said discrete particles from each of the intensity signals corresponding to said one discrete particle received from each of said sensors, and means for coordinating the intensity signals with each other such that a likelihood of at least one of the discrete particles to initiate the fire is calculated and established on a basis of the signals received from each of the sensors.

2. The safety system according to claim 1, wherein the sensors are arranged uniformly around an inner peripheral surface of a tube of circular cross section.

3. The safety system according to claim 1, wherein the sensors are arranged opposite one another on an inner peripheral surface of a tube having an angled cross section, said sensors being placed in corners of said cross section.

4. The safety system according to claim 1, wherein the sensors are arranged symmetrically and opposite one another around an inner peripheral surface of a tube having a rectangular cross section.

5. The safety system according to claim 1, wherein the intensity signals are one of at least partially summed, averaged, and inhibited, the evaluating means includes a comparison circuit evaluating the intensity signals in order to ascertain whether or not the intensity signals exceed a given value, and the coordinating means includes another circuit for choosing a degree of activation.

6. The safety system according to claim 1, wherein each sensor has a sensing angle of about 180°.

7. The safety system according to claim 1, wherein each of the sensors includes a plurality of mutually adjacent slots which are oriented in a direction at substantially right angles to a direction of movement of said material.

8. A safety system for use with a process in which high temperature particles are transported along a transportation path, the safety system comprising:

a plurality of sensors for sensing intensity of the high temperature particles which are being transported, the plurality of sensors being capable of sensing intensity of the high temperature particles in a cross section of the transportation path along which the high temperature particles are transported, the plurality of sensors being capable of sending intensity signals corresponding to at least one of the high temperature particles; and an indicating and activating unit in communication with each of the plurality of sensors for receiving the intensity signals from the plurality of sensors, the indicating and activating unit including means for evaluating the intensity signals corresponding to one of said high temperature particles by completing one of inhibiting intensity signals that exceed a predetermined value and at least summing intensity signals that are below the predetermined value.

9. The safety system according to claim 8, wherein the transportation path has an inner surface and the plurality of sensors are substantially equidistantly spaced on the inner surface of the cross section.

10. The safety system according to claim 9, wherein the cross section is circular.

11. The safety system according to claim 8, wherein the indicating and activating unit further includes means for coordinating the intensity signals with respect to a further value in order to determine a likelihood that the high temperature particles may initiate a combustion of other flammable particles.

12. The safety system according to claim 11, wherein the indicating and activating unit further includes means for activating a safety measure to prevent the combustion in response to the likelihood.

13. The safety system according to claim 12, further comprising a plurality of safety measures, the activation of each of the safety measures corresponding to different predetermined established likelihoods.

14. The safety system according to claim 12, wherein the activation of the safety measure corresponds to a predetermined established likelihood.

15. The safety system according to claim 8, wherein the means for evaluating the intensity signals corresponding to one of said high temperature particles inhibits the intensity signals that exceed the predetermined valve and sums the intensity signals that are below the predetermined value.

16. A safety system for use with a process in which high temperature particles are transported along a transportation path, the safety system comprising:

a plurality of sensors for sensing intensity of the high temperature particles which are being transported, the plurality of sensors being capable of sensing intensity of the high temperature particles in a cross section of the transportation path along which the high temperature particles are transported, the plurality of sensors being capable of sending intensity signals corresponding to at least one of the high temperature particles; and an indicating and activating unit in communication with each of the plurality of sensors for receiving the intensity signals from the plurality of sensors, the indicating and activating unit including means for averaging a plurality of the intensity signals received by the indicating and activating unit corresponding to one of said high temperature particles.

* * * * *